US008273199B1

(12) United States Patent
Hordos et al.

(10) Patent No.: US 8,273,199 B1
(45) Date of Patent: Sep. 25, 2012

(54) GAS GENERATING COMPOSITIONS WITH AUTO-IGNITION FUNCTION

(75) Inventors: Deborah L. Hordos, Troy, MI (US); Sudhakar R. Ganta, Troy, MI (US); Graylon K. Williams, Warren, MI (US); Sean P. Burns, Almont, MI (US)

(73) Assignee: TK Holdings, Inc., Armada, MI (US)

( * ) Notice: Subject to any disclaimer, the term of this patent is extended or adjusted under 35 U.S.C. 154(b) by 132 days.

(21) Appl. No.: 12/384,563

(22) Filed: Apr. 7, 2009

Related U.S. Application Data

(60) Provisional application No. 61/200,410, filed on Nov. 28, 2008.

(51) Int. Cl.

| | |
|---|---|
| ***C06B 31/00*** | (2006.01) |
| ***C06B 31/02*** | (2006.01) |
| ***D03D 23/00*** | (2006.01) |
| ***D03D 43/00*** | (2006.01) |

(52) U.S. Cl. ..... 149/61; 149/45; 149/109.2; 149/109.4

(58) Field of Classification Search ..... 149/62, 149/45, 61, 109.2, 109.4

See application file for complete search history.

(56) References Cited

U.S. PATENT DOCUMENTS

| | | | | |
|---|---|---|---|---|
| 5,035,757 | A * | 7/1991 | Poole | 149/46 |
| 5,139,588 | A * | 8/1992 | Poole | 149/61 |
| 5,386,775 | A * | 2/1995 | Poole et al. | 102/289 |
| 5,431,103 | A * | 7/1995 | Hock et al. | 102/289 |
| 5,467,715 | A * | 11/1995 | Taylor et al. | 102/289 |
| 5,501,823 | A * | 3/1996 | Lund et al. | 264/3.1 |
| 6,033,500 | A | 3/2000 | Ito et al. | |
| 6,177,028 | B1 | 1/2001 | Kanda et al. | |
| 6,302,979 | B1 | 10/2001 | Matsuoka | |
| 6,562,087 | B1 * | 5/2003 | Kodama et al. | 44/628 |
| 6,854,395 | B2 | 2/2005 | Katsuda | |
| 2005/0263223 | A1 * | 12/2005 | Halpin et al. | 149/19.6 |

OTHER PUBLICATIONS

Office Action U.S. Appl. No. 12/384,632, filed Apr. 7, 2009, Mailed Oct. 21, 2011 (196).

* cited by examiner

*Primary Examiner* — James McDonough
(74) *Attorney, Agent, or Firm* — L.C. Begin & Associates, PLLC

(57) ABSTRACT

The present invention generally relates to auto-ignition/booster compositions for inflators of occupant restraint systems, for example. An auto-ignition/booster and/or gas generant composition in accordance with the present invention includes an aromatic acid selected from tetrazoles, carboxylic acid/benzene-based fuels, nitrotriazoles, aminonitrotriazoles, aminotriazoles, bistetrazolylamines, bitetrazoles, and mixtures thereof; an alkali metal nitrate selected from potassium nitrate and sodium nitrate, and mixtures thereof; a basic constituent; and a catalytic non-oxidizing molybdenum-containing additive. A gas generator and a gas generating system including compositions of the present invention are also contemplated.

16 Claims, 1 Drawing Sheet

GAS GENERATING COMPOSITIONS WITH AUTO-IGNITION FUNCTION

CROSS REFERENCE TO RELATED APPLICATIONS

This application claims the benefit of U.S. Provisional Application Ser. No. 61/200,410 filed on Nov. 28, 2008.

BACKGROUND OF THE INVENTION

Auto-ignition materials in automotive air bag inflators allow the device to safely deploy in the event of a fire. By including an auto-ignition composition the likelihood of a safety hazard resulting from the bursting of an inflator is substantially reduced.

On the other hand, gas generating compositions typically produce relatively larger amounts of gas as compared to auto-ignition compositions. The gas generating composition must not only burn with sustained combustion, it must also liberate the desired amounts of gases within the desired unit of time. Typically, most compositions that are useful as gas generating compositions do not function as auto-ignition compositions because most gas generating compositions do not auto-ignite at temperatures that would make them useful as auto-ignition compositions. Stated another way, most gas generating compositions auto-ignite at temperatures substantially greater than 250 degrees Celsius and are therefore not desirable as auto-ignition compositions within automotive applications, for example. It is therefore an ongoing challenge to optimize the gas generating characteristics with a relatively lower auto-ignition temperature to potentially provide a gas generating composition that in addition to generating gas at useful amounts, also provides auto-ignition function within the same composition, at a temperature substantially lower than the melting point of the gas generating composition.

Accordingly, most inflators or gas generators for vehicle occupant protection systems, for example, typically include an auto-ignition composition juxtaposed next to a gas generating composition. In the event of a fire, the auto-ignition composition ignites to thereby ignite the main gas generating composition for safe management of the gas generating composition. As such, the fire hazard is substantially mitigated.

Other concerns include hygroscopicity of the auto-ignition compositions whereby ignitability and sustained combustion are adversely affected by moisture liberated during aging of the compositions. Yet another concern includes thermal stability and reliable auto-ignition at temperatures below 215 C after testing at 107 C for 400 hours (such as in the USCAR requirements).

An ongoing challenge is to continue simplification of gas generator manufacturing processes thereby resulting in lower overall costs. As such, combining the auto-ignition and gas generating compositions into one composition would simplify the manufacture and assembly of a gas generator, one employed in a vehicle occupant protection system for example.

SUMMARY

The above-referenced concerns and others are addressed by the compositions of the present invention. The present invention provides a gas generant system that includes at least one of the following: improved effluent quality; improved booster performance; auto-ignition at less than 215 C, and more preferably at less than 205 C and even more preferably at less than 200 C; and enhanced stability when aged for about 400 hours at about 107 C.

A composition in accordance with the present invention includes a primary fuel, a salt of tetrazole, a metallic oxidizer, and a catalyst. An acidic and aromatic primary fuel is provided that is selected from a tetrazole such as 5-aminotetrazole; a benzene-based fuel such as dinitrobenzoic acid, dinitrobenzamide; and nitroisophthalic acid; and mixtures thereof. The primary fuel is generally provided at about 1-50 wt % of the total composition.

The composition also contains an aromatic or non-aromatic basic constituent is selected from amino compounds, salts of amino compounds, alkali metal salt such as a salt of tetrazole is selected from alkali metal salts including potassium 5-aminotetrazole and sodium 5-aminotetrazole, a potassium salt of an aromatic or benzene-based salt such as potassium dinitrobenzoate, and mixtures thereof. The basic constituent is generally provided at about 1-50 wt % of the total composition.

An oxidizer is selected from metal oxidizers including alkali metal oxidizers such as potassium nitrate, sodium nitrate, and mixtures thereof. The metallic oxidizer is generally provided at about 35-75 wt % of the total composition.

An additive is provided from catalytic non-oxidizing molybdenum-containing constituents including powdered molybdenum, molybdenum trioxide, and mixtures thereof. The catalyst is generally provided at about 1-10 wt % of the total composition.

DETAILED DESCRIPTION OF THE INVENTION

Figure 1:
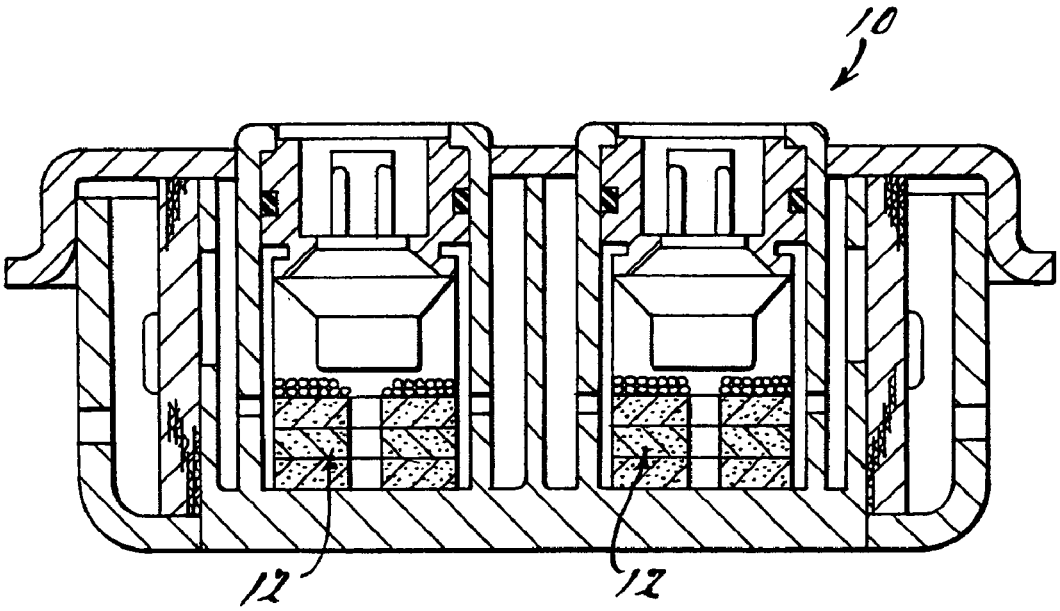
FIG. 1 is a cross-sectional view of an inflator assembly in accordance with the present invention.

The present invention provides a gas generant system that includes at least one of the following: improved effluent quality; improved booster performance; auto-ignition at less than 215 C, and more preferably at less than 205 C, and even more preferably at less than 200 C; and enhanced stability when aged for about 400 hours at about 107 C.

A composition in accordance with the present invention includes a primary fuel, a salt of tetrazole, a metallic oxidizer, and a catalyst. A primary fuel is provided that is selected from a tetrazole such as 5-aminotetrazole; a carboxylic acid or benzene-based fuel such as dinitrobenzoic acid, dinitrobenzamide, nitroisophthalic acid, and mixtures thereof. Other primary fuels include nitrotriazoles, aminonitrotriazoles, aminotriazoles, and mixtures thereof. The primary fuel is generally provided at about 1-50 wt % of the total composition.

A basic constituent is selected from aromatic and non-aromatic alkali metal salts, amino compounds, salts of amino compounds, and mixtures thereof. The aromatic and non-aromatic salts are selected from compounds including alkali metal salts such as a salt of tetrazole selected from potassium 5-aminotetrazole and sodium 5-aminotetrazole, potassium carbonate, monopotassium tartrate, dipotassium tartrate, potassium salts of aromatic benzene-based fuels such as potassium dinitrobenzoate, potassium 3-nitro-1,2,4-triazol-5-one, and mixtures thereof. Other basic constituents or compounds useful in the present invention include ammonium salts such as ammonium 3-nitro-1,2,4-triazol-5-one (ammonium NTO), and, amino compounds such as 3-amino 1,2,4-triazine, 2-amino pyrimidine, 3,5-diamino-1,2,4-triazole, and mixtures thereof. The basic constituent is generally provided at about 1-50 wt % of the total composition. A "basic constituent" is defined as a compound that functions as a Lewis base upon ignition.

An oxidizer is selected from metal oxidizers including alkali metal oxidizers such as potassium nitrate, and sodium nitrate. The metallic oxidizer is generally provided at about 35-75 wt % of the total composition.

A catalyst is provided for example from non-oxidizing catalytic molybdenum-containing compounds such as powdered molybdenum, molybdenum trioxide, ammonium molybdate, molybdic acid, sodium molybdate, phosphomolybdic acid, sodium phosphomolybdate, potassium molybdate, molybdenum dioxide, molybdenum trichloride, molybdenum dichloride dioxide, molybdenum carbide, molybdenum tetrachloride oxide, molybdenum silicide, molybdenum acetate dimer; and mixtures thereof. The catalyst is generally provided at about 1-10 wt % of the total composition.

EXAMPLES

Example 1

A composition containing about 30 wt % of 5-aminotetrazole, about 10 wt % of potassium 5-aminotetrazole, about 5 wt % of molybdenum trioxide, about 55 wt % of potassium nitrate (provided in approximately stoichiometric amounts calculated to oxidize 5-aminotetrazole and potassium 5-aminotetrazole) was formed by granulating each constituent to a desired size, in a known manner, and then blending and mixing each constituent to form a homogeneous composition. Each composition was then pelletized to form gas generating pellets as known in the art. The constituents are provided as a weight percent of the total composition. Hot plate tests, to determine hot plate ignition temperatures, were conducted by providing an aluminum plate approximately six inches in diameter and about 0.5 inches thick. A recessed portion was created in the middle portion of the aluminum plate. A thermocouple was embedded in the aluminum plate to determine the temperature and temperature differential. For each test conducted, a 250 mg sample was placed in the recess and the aluminum plate was heated at about 40 C per minute. The hot plate ignition temperature of this composition was determined to be 183 C. When heat aged at 107 C for 400 hours, the hot plate ignition temperature was determined to be 185 C, and mass loss was 0.3 wt %, indicative of high thermal stability. The term "ignition" means thermal ignition resulting in combustion as differentiated from decomposition. Combustion is seen as spontaneous light-emitting immediate conflagration with the resultant ash. As referred to throughout this specification and examples, hot plate ignition temperatures were determined in the same way as described herein.

Example 2

In another embodiment, a composition containing about 6 wt % of 5-aminotetrazole and about 16 wt % of dinitrobenzoic acid, about 16 wt % of potassium 5-aminotetrazole, about 5 wt % of molybdenum trioxide, about 57 wt % of potassium nitrate was formed as provided in Example 1. The constituents are provided as a weight percent of the total composition. The hot plate ignition temperature was determined to be 184 C. When heat aged at 107 C for 400 hours, the hot plate ignition temperature was determined to be 185 C, and mass loss was 0.26 wt %.

Example 3

In another embodiment, a composition containing about 16 wt % of 5-aminotetrazole, about 26 wt % of potassium 5-aminotetrazole, about 5 wt % of molybdenum trioxide, about 53 wt % of potassium nitrate was formed as described in Example 1. The constituents are provided as a weight percent of the total composition. The hot plate ignition temperature was determined to be 187 C. When heat aged at 107 C for 400 hours, the hot plate ignition temperature was determined to be 187 C, and mass loss was 0.05 wt %.

Example 4

In another embodiment, a composition containing about 20 wt % of dinitrobenzoic acid, about 20 wt % of potassium 5-aminotetrazole, about 5 wt % of molybdenum trioxide, about 55 wt % of potassium nitrate was formed as provided in Example 1. The constituents are provided as a weight percent of the total composition. The hot plate ignition temperature was determined to be 187 C. When heat aged at 107 C for 400 hours, the hot plate ignition temperature was determined to be 188 C, and mass loss was 0.4 wt %.

Example 5

In another embodiment, a composition containing about 5 wt % of 5-aminotetrazole and about 16 wt % of nitroisophthalic acid, about 16 wt % of potassium 5-aminotetrazole, about 5 wt % of molybdenum trioxide, about 58 wt % of potassium nitrate was formed as provided in Example 1. The constituents are provided as a weight percent of the total composition. The hot plate ignition temperature was determined to be 181 C. When heat aged at 107 C for 400 hours, the hot plate ignition temperature was determined to be 183 C, and mass loss was 0.2 wt %.

Example 6

In another embodiment, a composition containing about 5 wt % of dinitrobenzamide and about 15 wt % of dinitrobenzoic acid, about 20 wt % of potassium 5-aminotetrazole, about 5 wt % of molybdenum trioxide, about 55 wt % of potassium nitrate was formed as provided in Example 1. The constituents are provided as a weight percent of the total composition. The hot plate ignition temperature was determined to be 181 C. When heat aged at 107 C for 400 hours, the hot plate ignition temperature was determined to be 180 C, and mass loss was 0.6 wt %.

Example 7

In another embodiment, a composition containing about 20 wt % of dinitrobenzoic acid, about 20 wt % of potassium 5-aminotetrazole, about 7 wt % of molybdenum trioxide, about 53 wt % of potassium nitrate was formed as provided in Example 1. The constituents are provided as a weight percent of the total composition. The hot plate ignition temperature was determined to be 186 C.

Example 8

In another embodiment, a composition containing about 18 wt % of dinitrobenzoic acid, about 21 wt % of potassium 5-aminotetrazole, about 7 wt % of molybdenum trioxide, about 54 wt % of potassium nitrate was formed as provided in Example 1. The constituents are provided as a weight percent of the total composition. The hot plate ignition temperature was determined to be 187 C.

Example 9

In another embodiment, a composition containing about 20 wt % of dinitrobenzoic acid, about 20 wt % of potassium 5-aminotetrazole, about 9 wt % of molybdenum trioxide, about 51 wt % of potassium nitrate was formed as provided in Example 1. The constituents are provided as a weight percent of the total composition. The hot plate ignition temperature was determined to be 186 C.

Example 10

In another embodiment, a composition containing about 20 wt % of 5-aminotetrazole and about 16 wt % of dinitrobenzoic acid, about 16 wt % of potassium 5-aminotetrazole, about 5 wt % of molybdenum trioxide, about 57 wt % of potassium nitrate was formed as provided in Example 1. The constituents are provided as a weight percent of the total composition. The hot plate ignition temperature was determined to be 184 C.

Example 11

In another embodiment, a composition containing about 18 wt % of dinitrobenzoic acid, about 20 wt % of potassium 5-aminotetrazole, about 9 wt % of molybdenum trioxide, about 53 wt % of potassium nitrate was formed as provided in Example 1. The constituents are provided as a weight percent of the total composition. The hot plate ignition temperature was determined to be 186 C.

Example 12

In another embodiment, a composition containing about 6 wt % of 5-aminotetrazole, about 16 wt % of potassium 5-aminotetrazole/dinitrobenzoic acid, about 5 wt % of molybdenum trioxide, about 73 wt % of potassium nitrate was formed as provided in Example 1. The constituents are provided as a weight percent of the total composition. The hot plate ignition temperature was determined to be 186 C.

Example 13

In another embodiment, a composition containing about 6 wt % of 5-aminotetrazole, about 16 wt % of potassium 5-aminotetrazole/dinitrobenzoic acid, about 7 wt % of molybdenum trioxide, about 71 wt % of potassium nitrate was formed as provided in Example 1. The constituents are provided as a weight percent of the total composition. The hot plate ignition temperature was determined to be 184 C.

Example 14

In another embodiment, a composition containing about 6 wt % of 5-aminotetrazole, about 16 wt % of potassium 5-aminotetrazole/dinitrobenzoic acid, about 9 wt % of molybdenum trioxide, about 69 wt % of potassium nitrate was formed as provided in Example 1. The constituents are provided as a weight percent of the total composition. The hot plate ignition temperature was determined to be 184 C.

Examples 15-30

In the examples tabled below, each composition was formed as provided in Example 1. The constituents are provided as a weight percent of the total composition.

TABLE 1

| | Examp | | | | | | | | | | | | | | | |
|---|---|---|---|---|---|---|---|---|---|---|---|---|---|---|---|---|
| | 15 | 16 | 17 | 18 | 19 | 20 | 21 | 22 | 23 | 24 | 25 | 26 | 27 | 28 | 29 | 30 |
| KNO3 | 51 | 51 | 53 | 53 | 55 | 54 | 53 | 52 | 57 | 56 | 55 | 54 | 58 | 57 | 56 | 55 |
| 5AT | 25 | 30 | 30 | 25 | 30 | 20 | 16 | 10 | 30 | 20 | 16 | 10 | 30 | 20 | 16 | 10 |
| K5AT | 15 | 10 | 10 | 15 | 10 | 21 | 26 | 33 | 10 | 21 | 26 | 33 | 10 | 21 | 26 | 33 |
| MoO3 | 9 | 9 | 7 | 7 | 5 | 5 | 5 | 5 | 3 | 3 | 3 | 3 | 2 | 2 | 2 | 2 |
| HP Ign | 180 | 182 | 183 | 181 | 183 | 186 | 187 | 197 | 186 | 187 | 187 | DNI | 190 | 189 | 195 | DNI |

DNI—Did Not Ignite

Examples 31-35

In the examples tabled below, each composition was formed as provided in Example 1. The constituents are provided as a weight percent of the total composition.

TABLE 2

| Examp | 31 | 32 | 33 | 34 | 35 |
|---|---|---|---|---|---|
| KNO3 | 55 | 53 | 54 | 51 | 53 |
| 3,5-DNBA | 20 | 20 | 18 | 20 | 18 |
| K5AT | 20 | 20 | 21 | 20 | 20 |
| MoO3 | 5 | 7 | 7 | 9 | 9 |
| HP Ign | 190 | 186 | 187 | 186 | 186 |

Examples 36-38

In the examples tabled below, each composition was formed as provided in Example 1. The constituents are provided as a weight percent of the total composition.

TABLE 3

| Examp | 36 | 37 | 38 |
|---|---|---|---|
| KNO3 | 57 | 55 | 53 |
| 5AT | 6 | 6 | 6 |
| 3,5-DNBA | 16 | 16 | 16 |
| K5AT | 16 | 16 | 16 |
| MoO3 | 5 | 7 | 9 |
| HP Ign | 186 | 184 | 184 |

Example 39

Comparative Example

A known composition "A" containing 2.85 grams of about 29% 5-aminotetrazole, about 6% potassium 5-aminotetrazole, about 57% strontium nitrate, and about 8% clay was formed as provided in Example 1. In accordance with the present invention, a composition "B" containing 2.19 grams of a composition as described in Example 1 was also provided for comparative purposes. To determine ballistic performance curves, each composition was combusted in an exemplary inflator described in U.S. Pat. No. 7,267,365 in a 60 L tank. The "Time to First Gas" for composition "A" was 7.0 ms. The "Time to First Gas" for composition "B" was 6.1 ms indicating an advantage for booster and gas generating functionality. The ballistic curves of both compositions, as measured by tank pressure over time were substantially equivalent even though composition "B" was provided at about 23% less by weight. This example illustrates that compositions of the present invention generate relatively greater amounts of gas over time as compared to known compositions.

When provided in a gas generator as described in U.S. Pat. No. 7,267,365 to Quioc, herein incorporated by reference in its entirety, the composition of Example 1 provided enhanced amounts of gas and yet used about 20-25% less weight. Composition "A" resulted in 2.2 mol/100 g, with 62% gas in the combustion products; 775 cal/g; 0.8 in/sec at 1000 psi; and did not auto-ignite. Composition "B" advantageously resulted in 2.3 mol/100 g, with 66% gas in the combustion products; 835 cal/g; 1.8 in/sec at 1000 psi; and auto-ignited at 152 C. Accordingly, not only did composition "B" provide better ballistic performance, but it also produced more gas per gram of gas generant, with an improved burn rate.

Example 40

Comparative Example

Compositions "A" and "B" were formed as provided in Example 39, except that 2.4 grams of composition "A" was provided and 2.0 grams of composition "B" was provided. Comparative tests were again conducted to evaluate ballistic performance of compositions of the present invention as compared to known compositions. The compositions were combusted in a 60 L tank at 85 C. The chamber pressure for composition "A" was maximized at about 54-55 MPa at about 0.013 s after combustion onset. The chamber pressure for composition "B" was maximized at about 42-43 MPa at about 0.012 s after combustion onset. The Tank Pressure over time was again roughly equivalent for both compositions.

The compositions were again combusted in a 60 L tank at −40 C. The chamber pressure for composition "A" was maximized at about 31-32 MPa at about 0.018 s after combustion onset. The chamber pressure for composition "B" was generally maximized at about 24-25 MPa at about 0.015 s after combustion onset. The Tank Pressure over time was lower than when conducted at 85 C but was again roughly equivalent for both compositions.

This illustrates that compositions of the present invention burn at lower pressures than compositions as known in the art. As a result, lighter-weight inflators may be employed with the present compositions, given the ignition and burn advantages at lower pressures. Furthermore, it will be appreciated that while sustained combustion is possible at lower temperatures, the sustained tank pressure over time is equivalent to known compositions, even though the known compositions are provided in greater amounts at a composition A:B ratio of 6:5. Accordingly, inflation profiles of both compositions in the weights given are essentially equivalent, while relatively smaller mass amounts of the present compositions is needed. Accordingly, inflators using the present inventions may be lighter weight and smaller as compared to inflators typically required when employing the known compositions.

Example 41

Comparative Example

Tablets of composition "A" of Example 39 was evaluated with regard to water absorption. When exposed to 35% relative humidity at 31 C for 24 hours, moisture content in the known composition increased from 0.0% to about 1.3%. In accordance with the present invention, tablets of composition "B" when exposed to the same conditions did not exceed 0.1% moisture content, said percents stated by weight. This example illustrates the relatively low hygroscopicity of the present compositions as compared to known compositions.

Example 42

Comparative Example

High density granules (HDG) of composition "A" of Example 39 were evaluated with regard to water absorption. When exposed to 40% relative humidity at 23 C for 4.8 hours, moisture content in the known composition increased to about 0.38%. In accordance with the present invention, high density granules of composition "B" when exposed to the same conditions did not exceed 0.15% moisture content, said percents stated by weight. This example illustrates the relatively low hygroscopicity of the present compositions as compared to known compositions.

Example 43

Comparative Example

Medium density granules of composition "A" of Example 39 were evaluated with regard to water absorption. When exposed to 40% relative humidity at 23 C for 4.8 hours, moisture content in the known composition increased to about 1.68%. In accordance with the present invention, high density granules of composition "B" when exposed to the same conditions exhibited a 0.92% moisture content, said percents stated by weight. This example illustrates the relatively low hygroscopicity of the present compositions as compared to known compositions.

Example 44

Comparative Example

Tablets of composition "A" of Example 8 were evaluated with regard to water absorption. When exposed to 40% relative humidity at 23 C for 4.8 hours, moisture content in the known composition increased to about 0.38%. In accordance with the present invention, tablets of composition "B" when exposed to the same conditions resulted in about 0.12 to 0.13% moisture content, said percents stated by weight. This example illustrates the relatively low hygroscopicity of the present compositions as compared to known compositions.

With regard to Examples 41-44, current auto-ignition materials generate some moisture during heat aging, which limits the amount that can be employed in the inflator. By minimizing the hygroscopicity of the present compositions, more of this composition may be employed in the inflator thereby facilitating the use of the present compositions as booster and/or gas generating compositions, in addition to being auto-ignition compositions. This would also mitigate the need for moisture countermeasures, such as desiccants or extensive environmental controls in the manufacturing facility. Overall, the total amount or volume of various compositions is decreased thereby facilitating the reduction in size of an associated gas generator, and making their use as auto-ignition/booster compositions more efficient in that the auto-ignition/gas generating/booster composition has greater conductive exposure to the surface of various gas generators. To illustrate, the multi-functional aspects of the present compositions, as an auto-ignition/booster composition for example, result in greater surface area contact of a typical booster tube thereby resulting in greater heat transfer from a variety of directions, in the event of a bonfire.

Example 45

A composition of Example 1 was combusted in an exemplary inflator described in U.S. Pat. No. 7,267,365 in a 60 L tank. The contents of the combustion residue were then determined. In particular, upon combustion at temperatures and pressures typical for airbag inflators, the residue was analyzed by x-ray diffraction to determine the ionic state of the molybdenum present after combustion. The residue of combustion was collected from the inner surfaces of the 60 L tank by rinsing the tank with 1 liter of de-ionized water and then collecting the solution by collection in a rinse basin. A squeegee was used to remove the de-ionized water solution from the inner walls of the tank for collection in the rinse basin. The rinse basin contents were then vacuum filtered to remove the insoluble solids from the rinse, as solid depositions remaining on filter paper. The solid depositions were then analyzed by x-ray diffraction.

With regard to analysis of the solids, x-ray diffraction results qualitatively indicated a majority of potassium carbonate hydrate, a minor amount of potassium carbonate, a minor amount of potassium molybdenum oxide, and a possible trace amount of molybdite. No other solids were identified. It will be appreciated that this example and x-ray analysis confirms that molybdenum trioxide or molybdite, containing molybdenum having a +6 ionic charge prior to combustion, was found in trace amounts in the combustion residue. It will also be appreciated that potassium molybdenum oxide found in the combustion residue also contains molybdenum having a +6 ionic charge. Accordingly, it will be appreciated that none of the molybdenum collected from the tank after combustion had undergone reduction in ionic charge, as would have occurred if the molybdenum trioxide or molybdite had functioned as an oxidizer. Accordingly, this example confirms that molybdenum trioxide does not at all function as an oxidizer when combusted in an airbag inflator, as known in the art.

Example 46

The composition of Example 1 was combusted as described in Example 45. The gaseous effluent was analyzed for solid content in microscopically-sized particulates, or particulates are generally too small for accurate analysis by x-ray diffraction. Stated another way, electron dispersion spectroscopy (EDS) analysis was performed on the airborne or respirable particulates that resulted from combustion. No molybdenum was identified in the solids.

Example 47

The composition of Example 1 was combusted as described in Example 45. The gaseous effluent was analyzed for solid content in microscopically-sized particulates, or particulates believed to be too small for accurate analysis by x-ray diffraction. Stated another way, electron dispersion spectroscopy (EDS) analysis was performed on the airborne or respirable particulates that resulted from combustion. No molybdenum was identified in the solids.

Example 48

The composition of Example 1 was combusted as described in Example 45. The gaseous effluent was analyzed for solid content in microscopically-sized particulates, or particulates believed to be too small for accurate analysis by x-ray diffraction. Stated another way, electron dispersion spectroscopy (EDS) analysis was performed on the airborne or respirable particulates that resulted from combustion. No molybdenum was identified in the solids.

Examples 49-87

For each example tabulated below, a booster composition containing 55% KNO3, 30% 5AT, 10% K5AT, and a respective additive as identified in each respective example were formed as provided in Example 1. The auto-ignition properties of each composition were identified as detailed below. Hot plate ignition temperatures were determined as described in Example 1. For each example, combustion temperatures were calculated to be about 1800 C.

TABLE 4

| Example | Additive | MP at/above Combust. temp, | MP below Combust. temp, C. | Hot Plate Ignit. Temp, C. |
|---|---|---|---|---|
| 49 | $(NH_4)_2MoO_4$ | | | 185 |
| 50 | $[(C_2H_3O_2)_2Mo]_2$ | | | 187 |
| 51 | $Ag_2O$ | | 200 (decomposed) | DNI <250 |
| 52 | $Al_2CoO_4$ | | | DNI <250 |
| 53 | $Al_2O_3$ | | | DNI <250 |
| 54 | $B_2O_3$ | | | DNI <250 |
| 55 | $Bi_2O_3$ | | | DNI <250 |
| 56 | $CeO_2$ | | | DNI <250 |
| 57 | $Co_3O_4$ | | 900 (converted to CoO) | DNI <250 |
| 58 | CoFeO | | | DNI <250 |
| 59 | CoO | 1795 | | DNI <250 |
| 60 | $Cr_2O_3$ | 2266 | | DNI <250 |
| 61 | $Cu_2O$ | | 1235 | DNI <250 |
| 62 | CuO | | 1236 | DNI <250 |
| 63 | $Fe_2O_3$ | | 1565 | DNI <250 |
| 64 | $H_2MoO_4$ | | | 189 |
| 65 | $K_2MoO_4$ | | 919 | 185 |
| 66 | MgO | | | DNI <250 |
| 67 | $MgO \bullet Al_2O_3$ | | | DNI <250 |
| 68 | $Mn_3O_4$ | | 1564 | DNI <250 |
| 69 | $MnO_2$ | | 535 (decomposed) | DNI <250 |
| 70 | Mo (nanopowder) | 2617 | | 202 |
| 71 | $Mo_2C$ | 2687 | | 206 |
| 72 | $MoCl_3$ | | (decomposed) | 184 |
| 73 | $MoO_2$ | | 1100 (decomposed) | 197 |

TABLE 4-continued

| Example | Additive | MP at/above Combust. temp, | MP below Combust. temp, C. | Hot Plate Ignit. Temp, C. |
|---|---|---|---|---|
| 74 | $MoO_2Cl_2$ | | (sublimes) | 178 |
| 75 | $MoO_3$ | | 795 | 184 |
| 76 | $MoSi_2$ | | | 211 |
| 77 | Nb2O5 | | 1520 | DNI <250 |
| 78 | NbO2 | 1902 | | DNI <250 |
| 79 | NiO | 1984 | | DNI <250 |
| 80 | Sc2O3 | >2400 | | DNI <250 |
| 81 | SnO2 | | 1127 | DNI <250 |
| 82 | V2O3 | 1970 | | DNI <250 |
| 83 | V2O5 | | 690 | 230 |
| 84 | WO3 | | 1472 | DNI <250 |
| 85 | Y2O3 | 2410 | | DNI <250 |
| 86 | ZnO | 1975 | | DNI <250 |
| 87 | ZrO2 | 2677 | | DNI <250 |

DNI—Did Not Ignite

As shown in Table 4, compositions containing most of the oxides shown therein did not result in the auto-ignition at temperatures at or below 215, and more preferably at or below 200. In contrast to other oxides, compositions containing molybdenum-containing oxides shown in Table 4 resulted in auto-ignition temperatures well below the combustion temperature of 1800 C, and at temperatures generally below 200-215 C. Furthermore, the auto-ignition of compositions containing molybdenum-containing additives or oxides occurred prior to melting or decomposition of the oxide.

Example 88

In another embodiment, a composition containing about 25 wt % of 5-aminotetrazole, about 10 wt % of potassium 5-aminotetrazole, and about 65 wt % of molybdenum trioxide was formed as provided in Example 1. The constituents are provided as a weight percent of the total composition. When evaluated for ignition by hot plate testing as described in Example 1, the composition did not ignite below or up to 270 C, at which point the test was terminated. During heating, the sample turned black, began to bubble, and then finally decomposed to a black residue. This confirms that molybdenum trioxide does not function as an oxidizer, particularly when compared to compositions containing potassium nitrate. The compositions containing potassium nitrate ignited and combusted as described in Example 1, whereas this composition did not ignite nor was it combusted. When considered in conjunction with the results of Example 45, it can be concluded that molybdenum trioxide simply does not function as an oxidizer.

Example 89

In another embodiment, a composition containing about 30 wt % of 3-Nitro-1,2,4-triazole, about 10 wt % of potassium 5-aminotetrazole, about 5 wt % of molybdenum trioxide, and about 55 wt % of potassium nitrate was formed as provided in Example 1. The constituents are provided as a weight percent of the total composition. The hot plate ignition temperature was determined to be 186 C. When at 107 C for 400 hours, the hot plate ignition temperature was determined to be 186 C Example 90

In another embodiment, a composition containing about 20 wt % of 3-Nitro-1,2,4-triazole, about 20 wt % of potassium 5-aminotetrazole, about 5 wt % of molybdenum trioxide, and about 55 wt % of potassium nitrate was formed as provided in Example 1. The constituents are provided as a weight percent of the total composition. The hot plate ignition temperature was determined to be 178 C.

Example 91

In another embodiment, a composition containing about 30 wt % of 5-aminotetrazole, about 10 wt % of ammonium 3-nitro-1,2,4-triazol-5-one, about 5 wt % of molybdenum trioxide, and about 55 wt % of potassium nitrate was formed as provided in Example 1. The constituents are provided as a weight percent of the total composition. The hot plate ignition temperature was determined to be 186 C. The NTO salt is derived from an organic acid (NTO) having a pKa of about 3.6, and therefore a relatively high gas yield, thereby making these types of compounds useful as gas generants and auto-ignition compounds, with relatively less solids being formed during combustion.

Example 92

In another embodiment, a composition containing about 30 wt % of 5-aminotetrazole, about 10 wt % of potassium 3-nitro-1,2,4-triazol-5-one, about 5 wt % of molybdenum trioxide, and about 55 wt % of potassium nitrate was formed as provided in Example 1. The constituents are provided as a weight percent of the total composition. The hot plate ignition temperature was determined to be 186 C.

Example 93

In another embodiment, a composition containing about 30 wt % of 5-aminotetrazole, about 10 wt % of 3-Amino-1,2,4-triazine, about 5 wt % of molybdenum trioxide, and about 55 wt % of potassium nitrate was formed as provided in Example 1. The constituents are provided as a weight percent of the total composition. The hot plate ignition temperature was determined to be 184 C.

Example 94

In another embodiment, a composition containing about 30 wt % of 5-aminotetrazole, about 10 wt % of 2-Amino pyrimidine, about 5 wt % of molybdenum trioxide, and about 55 wt % of potassium nitrate was formed as provided in Example 1. The constituents are provided as a weight percent of the total composition. The hot plate ignition temperature was determined to be 185 C.

Example 95

In another embodiment, a composition containing about 30 wt % of 5-aminotetrazole, about 10 wt % of 3,5-Diamino-1,2,4-triazole, about 5 wt % of molybdenum trioxide, and about 55 wt % of potassium nitrate was formed as provided in Example 1. The constituents are provided as a weight percent of the total composition. The hot plate ignition temperature was determined to be 185 C.

Example 96

In another embodiment, a composition containing about 30 wt % of 5-aminotetrazole, about 10 wt % of potassium 3,5-dinitrobenzoate (potassium salt of dinitrobenzoic acid), about 5 wt % of molybdenum trioxide, and about 55 wt % of potassium nitrate was formed as provided in Example 1. The constituents are provided as a weight percent of the total composition. The hot plate ignition temperature was determined to be 189 C.

The compositions of the present invention are formed from constituents as provided by known suppliers such as Aldrich, GFS, or Fisher Chemical companies. The compositions may be provided in granulated form and dry-mixed and compacted in a known manner, or otherwise mixed and formed into gas generant shapes and sizes, as known in the art. The compositions may be employed in gas generators typically found in airbag devices or occupant protection systems, or in safety belt devices, or in gas generating systems such as a vehicle occupant protection system, all manufactured as known in the art, or as understood by one of ordinary skill.

In yet another aspect, a method of providing safe management of a gas generant composition in the advent of a fire is provided including the steps of: 1) providing an auto-ignition composition containing: an aromatic acid as a fuel, selected from a fuel including the fuels described herein; a basic constituent selected from potassium and ammonium salts and amino compounds; an alkali metal nitrate provided in approximate stoichiometric molar amounts or excess molar amounts sufficient to oxidize the fuel and the basic constituent; and a catalytic and non-oxidizing molybdenum-containing additive, wherein the auto-ignition temperature of the composition is at or below 215 C. The auto-ignition composition may also function as a gas generating composition in an airbag inflator, for example, in a known way. Or, alternatively, the auto-ignition composition may simply be in thermodynamic communication with the exterior of an associated gas generator containing the auto-ignition composition and the gas generant composition, and in operable communication with the gas generant composition if both compositions are distinct.

Further management of the gas generant composition results upon the occurrence of a bonfire and includes: 2) igniting the auto-ignition composition at temperatures below 215 C to begin combustion thereof, and 3) combusting the gas generant composition and auto-ignition composition. The term "basic constituent" as used in this invention is defined as a compound that functions as a Lewis base insitu, or upon ignition.

It will be appreciated that many original equipment manufacturers require that measures be taken to ensure the safety of any humans surrounding or benefiting from safety equipment such as a vehicle occupant protection system. As such, one challenge when manufacturing an associated gas generator for example, is to provide safe management of the primary gas generating charge within an associated inflator. Again, as described herein, an auto-ignition composition may be placed in close and operative proximity to the gas generating composition to initiate combustion early on in the event of a fire during shipping or storage for example. In accordance with the present invention, the gas generating composition and the auto-ignition composition may in fact be the same composition as provided for herein. As such, yet another step in the method of providing safe management may be to provide a composition that functions as both a gas generating and auto-ignition composition. The ability to function as a gas generating composition wherein useful and sufficient amounts of gas are produced to inflate an airbag or tension a seatbelt for example while yet including auto-ignition function in the same composition is an improvement resulting in superior performance as compared to other exemplary gas generators while yet simplifying the manufacture of the inflators.

The compositions of the present invention are formed from constituents as provided by known suppliers such as Aldrich or Fisher Chemical companies. The compositions may be provided in granulated form and dry-mixed and compacted in a known manner, or otherwise mixed as known in the art. The compositions may be employed in gas generators typically found in airbag devices or occupant protection systems, or in safety belt devices, or in gas generating systems such as a vehicle occupant protection system, all manufactured as known in the art, or as appreciated by one of ordinary skill.

As shown in FIG. 1, an exemplary inflator or gas generating system 10 incorporates a dual chamber design to tailor containing a primary gas generating composition 12 formed as described herein, may be manufactured as known in the art. U.S. Pat. Nos. 6,422,601, 6,805,377, 6,659,500, 6,749,219, and 6,752,421 exemplify typical airbag inflator designs and are each incorporated herein by reference in their entirety.

Figure 2:
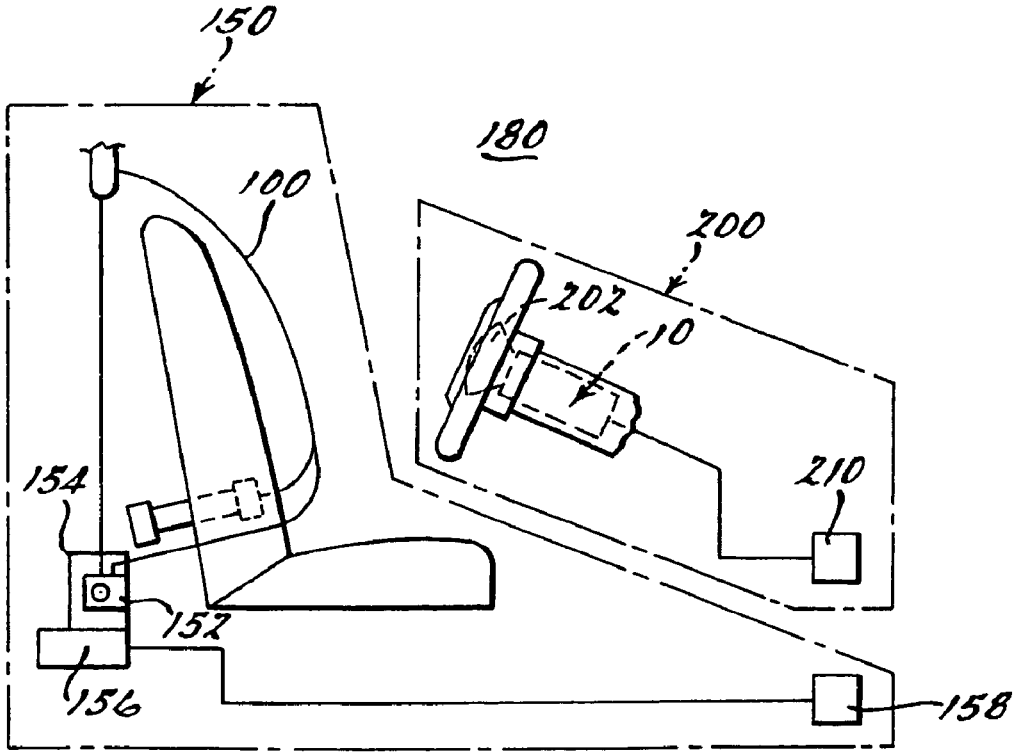
FIG. 2 is a schematic view of a gas generating system and a vehicle occupant restraint system incorporating the composition of the present invention.

Referring now to FIG. 2, the exemplary inflator or gas generating system 10 described above may also be incorporated into an airbag system 200. Airbag system 200 includes at least one airbag 202 and an inflator 10 containing a gas generant composition 12 in accordance with the present invention, coupled to airbag 202 so as to enable fluid communication with an interior of the airbag. Airbag system 200 may also include (or be in communication with) a crash event sensor 210. Crash event sensor 210 includes a known crash sensor algorithm that signals actuation of airbag system 200 via, for example, activation of airbag inflator 10 in the event of a collision.

Referring again to FIG. 2, airbag system 200 may also be incorporated into a broader, more comprehensive vehicle occupant restraint system 180 including additional elements such as a safety belt assembly 150. FIG. 2 shows a schematic diagram of one exemplary embodiment of such a restraint system. Safety belt assembly 150 includes a safety belt housing 152 and a safety belt 100 extending from housing 152. A safety belt retractor mechanism 154 (for example, a spring-loaded mechanism) may be coupled to an end portion of the belt. In addition, a safety belt pretensioner 156 containing gas generating/auto ignition composition 12 may be coupled to belt retractor mechanism 154 to actuate the retractor mechanism in the event of a collision. Typical seat belt retractor mechanisms which may be used in conjunction with the safety belt embodiments of the present invention are described in U.S. Pat. Nos. 5,743,480, 5,553,803, 5,667,161, 5,451,008, 4,558,832 and 4,597,546, incorporated herein by reference. Illustrative examples of typical pretensioners with which the safety belt embodiments of the present invention may be combined are described in U.S. Pat. Nos. 6,505,790 and 6,419,177, incorporated herein by reference.

Safety belt assembly 150 may also include (or be in communication with) a crash event sensor 158 (for example, an inertia sensor or an accelerometer) including a known crash sensor algorithm that signals actuation of belt pretensioner 156 via, for example, activation of a pyrotechnic igniter (not shown) incorporated into the pretensioner. U.S. Pat. Nos. 6,505,790 and 6,419,177, previously incorporated herein by reference, provide illustrative examples of pretensioners actuated in such a manner.

It should be appreciated that safety belt assembly 150, airbag system 200, and more broadly, vehicle occupant protection system 180 exemplify but do not limit gas generating systems contemplated in accordance with the present invention.

It will be understood that the foregoing description of an embodiment of the present invention is for illustrative purposes only. As such, the features herein disclosed are susceptible to a number of modifications commensurate with the abilities of one of ordinary skill in the art, none of which departs from the scope of the present invention as defined in the appended claims.

What is claimed is:

1. A gas generating system comprising a composition, the composition of:

an aromatic acid as a primary fuel;

a basic constituent;

an alkali metal nitrate provided in amounts sufficient to result in the oxidation of said primary fuel and said basic constituent upon combustion thereof; and a catalytic non-oxidizing molybdenum-containing additive.

2. The gas generating system of claim 1 further comprising an inflator containing said composition, wherein said composition functions as an auto-ignition and booster compound.

3. The gas generating system of claim 1 wherein said basic constituent is selected from the group consisting of aromatic and non-aromatic alkali metal salts, amino compounds, alkali metal salts of amino compounds, ammonium salts, and mixtures thereof.

4. The gas generating system of claim 3 wherein said alkali metal salts are selected from the group consisting of potassium salts of azoles.

5. The gas generating system of claim 1 wherein said aromatic acid is selected from the group consisting of tetrazoles, carboxylic acid/benzene-based fuels, nitrotriazoles, aminonitrotriazoles, aminotriazoles, bistetrazolylamines, bitetrazoles, and mixtures thereof.

6. The gas generating system of claim 1 wherein said alkali metal nitrate is selected from potassium nitrate and sodium nitrate, and mixtures thereof.

7. The gas generating system of claim 1 wherein said aromatic acid is selected from the group consisting of 5-aminotetrazole, dinitrobenzoic acid, dinitrobenzamide, nitroisophthalic acid, and mixtures thereof.

8. The gas generating system of claim 1 wherein said molybdenum-containing additive is selected from the group consisting of powdered molybdenum, molybdenum trioxide, ammonium molybdate, molybdic acid, sodium molybdate, phosphomolybdic acid, sodium phosphomolybdate, potassium molybdate, molybdenum dioxide, molybdenum trichloride, molybdenum dichloride dioxide, molybdenum carbide, molybdenum tetrachloride oxide, molybdenum silicide, molybdenum acetate dimer, and mixtures thereof.

9. The composition of claim 1 wherein said aromatic acid is provided at about 1-30 wt % of the total composition, said basic constituent is provided at about 1-30 wt % of the total composition, the oxidizer is generally provided at about 35-75 wt % of the total composition, and the molybdenum-containing additive is provided at about 1-10 wt % of the total composition.

10. A gas generating system comprising a composition, the composition of:

an aromatic acid selected from the group consisting of tetrazoles, carboxylic acid/benzene-based fuels, nitrotriazoles, aminonitrotriazoles, aminotriazoles, bistetrazolylamines, bitetrazoles, and mixtures thereof, said acids provided at about 1-30 wt % of the total composition;

a basic constituent provided at about 1-30 wt % of the total composition;

an alkali metal nitrate selected from the group consisting of potassium nitrate and sodium nitrate, and mixtures thereof, said alkali metal nitrate provided at about 35-75 wt % of the total composition, and said alkali metal nitrate provided at substantial or approximate stoichiometric amounts to oxidize the fuel and the basic constituent; and a catalytic non-oxidizing molybdenum-containing additive provided at about 1-10 wt % of the total composition.

11. The gas generating system of claim 8 wherein said composition includes 5-aminotetrazole, potassium 5-aminotetrazole, potassium nitrate, and molybdenum trioxide.

12. The gas generating system of claim 10 wherein said basic constituent is aromatic or non-aromatic and is selected from metal salts, amino compounds, alkali metal salts of amino compounds, ammonium salts, and mixtures thereof.

13. The gas generating system of claim 10 wherein said catalytic non-oxidizing molybdenum-containing additive is selected from the group consisting of powdered molybdenum, molybdenum trioxide, ammonium molybdate, molybdic acid, sodium molybdate, phosphomolybdic acid, sodium phosphomolybdate, potassium molybdate, molybdenum dioxide, molybdenum trichloride, molybdenum dichloride dioxide, molybdenum carbide, molybdenum tetrachloride oxide, molybdenum silicide, molybdenum acetate dimer; and mixtures thereof.

14. A gas generating system comprising an composition, the composition comprising:

a fuel selected from the group consisting of dinitrobenzoic acid, dinitrobenzamide, nitroisophthalic acid, and mixtures thereof;

a basic constituent;

an alkali metal nitrate provided at amounts sufficient to oxidize the fuel and basic constituent;

a catalytic non-oxidizing molybdenum-containing additive selected from the group consisting of powdered molybdenum, molybdenum trioxide, ammonium molybdate, molybdic acid, sodium molybdate, phosphomolybdic acid, sodium phosphomolybdate, potassium molybdate, molybdenum dioxide, molybdenum trichloride, molybdenum dichloride dioxide, molybdenum carbide, molybdenum tetrachloride oxide, molybdenum silicide, molybdenum acetate dimer; and mixtures thereof.

15. The composition of claim 14 wherein said composition comprises about 30 wt % 5-aminotetrazole, about 10 wt % potassium 5-aminotetrazole, about 55 wt % potassium nitrate, and about 5 wt % molybdenum trioxide as a catalytic non-oxidizing compound.

16. The composition of claim 1 wherein the composition is formed from 5-aminotetrazole; a basic constituent selected from the group consisting of alkali metal salts of tetrazoles, amino compounds, alkali metal salts of amino compounds, ammonium salts, and mixtures thereof; potassium nitrate; and molybdenum trioxide.

* * * * *

UNITED STATES PATENT AND TRADEMARK OFFICE

CERTIFICATE OF CORRECTION

PATENT NO. : 8,273,199 B1
APPLICATION NO. : 12/384563
DATED : September 25, 2012
INVENTOR(S) : Hordos et al.

It is certified that error appears in the above-identified patent and that said Letters Patent is hereby corrected as shown below:

Col. 15, Line 6, Claim 1; Insert --consisting-- after composition.

Col. 15, Line 54, Claim 10; Insert --consisting-- after composition.

Signed and Sealed this
Eighteenth Day of December, 2012

David J. Kappos

David J. Kappos
*Director of the United States Patent and Trademark Office*